US007901307B2

(12) United States Patent
Hansez-Gonne

(10) Patent No.: US 7,901,307 B2
(45) Date of Patent: Mar. 8, 2011

(54) MULTIFUNCTIONAL PROTECTION SYSTEM FOR A SPORTS GROUND

(76) Inventor: Bernard Hansez-Gonne, Aywaille (BE)

( * ) Notice: Subject to any disclaimer, the term of this patent is extended or adjusted under 35 U.S.C. 154(b) by 104 days.

(21) Appl. No.: 12/438,687

(22) PCT Filed: Aug. 28, 2008

(86) PCT No.: PCT/BE2007/000099

§ 371 (c)(1),
(2), (4) Date: Feb. 24, 2009

(87) PCT Pub. No.: WO2008/025104

PCT Pub. Date: Mar. 6, 2008

(65) Prior Publication Data

US 2010/0004076 A1 Jan. 7, 2010

(30) Foreign Application Priority Data

Sep. 1, 2006 (EP) ..... 06447100

(51) Int. Cl.
*A63C 19/12* (2006.01)

(52) U.S. Cl. ..... 473/504

(58) Field of Classification Search ..... 473/504; 135/115, 119; 242/919, 403, 392; 206/389
See application file for complete search history.

(56) References Cited

U.S. PATENT DOCUMENTS

| | | | | | |
|---|---|---|---|---|---|
| 1,088,407 | A | * | 2/1914 | Derr | 473/504 |
| 1,528,375 | A | | 3/1925 | Hampden et al. | |
| 1,966,687 | A | * | 7/1934 | Scott et al. | 473/504 |
| 2,578,135 | A | * | 12/1951 | Hoigaard et al. | 473/504 |
| 2,848,233 | A | * | 8/1958 | Wynn | 473/504 |
| 3,108,804 | A | * | 10/1963 | Wagner | 473/504 |
| 3,300,211 | A | * | 1/1967 | Maring | 473/504 |
| 3,395,918 | A | | 8/1968 | Scoville | |
| 4,050,972 | A | | 9/1977 | Cardinal, Jr. | |
| 4,641,600 | A | * | 2/1987 | Halvorsen | 114/361 |
| 6,435,443 | B1 | * | 8/2002 | Lauritzen | 242/390.9 |
| 7,195,572 | B1 | * | 3/2007 | Swain | 473/504 |

FOREIGN PATENT DOCUMENTS

| | | | |
|---|---|---|---|
| DE | 41 37 295 | A1 | 4/1993 |
| EP | 0 236 983 | A2 | 9/1987 |
| EP | 0 427 677 | A1 | 5/1991 |
| WO | WO 88/05678 | A1 | 8/1988 |
| WO | WO 95/09681 | A2 | 4/1995 |
| WO | WO 99/01187 | A1 | 1/1999 |

* cited by examiner

*Primary Examiner* — Mitra Aryanpour
(74) *Attorney, Agent, or Firm* — Reinhart Boerner Van Deuren P.C.

(57) ABSTRACT

The present invention relates to a protection system for a sports ground comprising a frame-chest with a protection cover, said frame-chest being able to move across the entire length of the ground whilst unfolding or folding said protection cover by means of an unfolding and folding mechanism, in which said frame-chest is connected to a network of cables spread out in advance over the sports ground, said cables being operated by motorized pulleys in order to ensure the motion of said frame-chest over said sports ground.

15 Claims, 12 Drawing Sheets

MULTIFUNCTIONAL PROTECTION SYSTEM FOR A SPORTS GROUND

FIELD OF THE INVENTION

The present invention relates to a multifunctional protection system for a sports ground, and in particular to a simple and quick device that is suitable for spreading out a protection cover over a sports ground in order to protect it from bad weather.

STATE OF THE ART

Protecting sports grounds is a constant concern and various systems are known in the existing state of the art.

Document U.S. Pat. No. 4,050,972 describes the assembly in situ of a covering for sports grounds, consisting in unrolling rolls of sheets of plastic materials that are mounted on spaced vehicles. The axles of the rolls are parallel and offset so that the sheets overlap and can be sealingly joined together as they are unrolled.

Documents EP 0 236 983, EP 0 427 677 and DE 4137295 also disclose various means for rolling and unrolling a protection cover for a sports ground.

In international patent application WO 95/09681, the covering of a sports ground is achieved by an assembly of panels telescopically linked so as to shift from a position covering the surface to a position uncovering it.

International patent application WO 88/05678 discloses an automatic device for covering sports grounds, comprising a series of modular strips that can slide over each other and are operated by a unrolling or rolling means.

Lastly, document WO 99/01187 discloses a motorized device for spreading out a protection cover over a sports ground, that can move across the ground in order to fold or unfold a cover. This motorized device comprises a frame equipped with wheels or rollers and a transmission system for its motion across the sports ground; it also comprises a cover arranged like a accordion in its folded position and a means for spreading out and folding back up the cover synchronously with a transmission system for moving the frame. One of the difficulties encountered with this device lies in the synchronisation of the motion speed of the various attached modular elements of the frame-chest required to cover the entire width of sports grounds. This difficulty is connected to the surface state of the ground which is not even and therefore offers different levels of resistance to the wheels or rollers at different spots and hence does not allow optimum synchronisation when the various bearing elements (attached to each other) are driven by individual motors. Moreover, the guiding ropes in this system are not efficiently collected when the cover is being folded up and the rings or buckles are not efficiently guided to ensure the correct folding of the cover.

AIMS OF THE INVENTION

The present invention aims to provide a protection system for a sports ground that does not have the drawbacks of the state of the art and that not only allows to spread out a protection cover over a sports ground in the simplest and quickest manner but also allows to fold this cover back up without problems.

SUMMARY OF THE INVENTION

The present invention discloses a protection system for a sports ground comprising a frame-chest with a protection cover, said frame being able to move across the entire length of the ground whilst unfolding or folding said protection cover by means of an unfolding and folding mechanism, wherein said frame-chest is connected to a network of cables spread out in advance over the sports ground, said cables being driven by motorized pulleys, in order to ensure the motion of said frame-chest over said sports ground.

According to particular embodiments, the invention comprises one or more of the following features:

- The frame-chest is divided into several modular elements that move synchronously over the sports ground thanks to said network of cables to which they are connected and that are driven by said motorized pulleys during unfolding or folding of said cover;
- The unfolding and folding mechanism for the cover comprises nipping rollers, said nipping rollers being themselves motorized and equipped with a regulation for their pressure force by means of arms with springs exerting a pressure force on pressure rollers, pressing them onto said cover, the cover being nipped between said nipping rollers and the pressure rollers;
- The unfolding and folding mechanism for the cover comprises guiding ropes fixed to the edge of the ground that are threaded through threading buckles located underneath said cover and guide said cover when it is folded or unfolded;
- When the cover is being folded up, said guiding ropes and said threading buckles are threaded through and around a threading tube, respectively;
- The mechanism comprises a reel for said guiding ropes, equipped with a winding spring that allows to progressively wind up or unwind the guiding rope, during the unfolding or folding of said cover, respectively;
- The unfolding and folding mechanism for the cover comprises a synchronisation system that synchronises the motion speed of said frame-chest by means of said motorized pulleys with the folding or unfolding speed of the cover by means of the motorized nipping rollers;
- Both the network of cables and said motorized pulleys are concealed at the edge of the ground when it is uncovered;
- The network of cables is gathered up at the edge of the ground by means of several winches;
- The frame-chest comprises a system for heating said cover;
- The frame-chest comprises a watering system;
- The frame-chest comprises a seeder for sowing grass;
- The frame-chest comprises supports for advertising signs;
- The cover may serve as an advertising support;
- The cover is translucent.

DEFINITIONS

The term "cable" in the expression "network of cables" must be interpreted in the widest sense and may of course mean "wire" or even "rope." The nature of the material used is not relevant as long as sufficient mechanical strength and the result sought are achieved.

The term "cover" should also be understood in the widest sense and as a general covering, it may for example mean "canvas."

The term "rope" or "guiding rope" is also to be understood in the widest sense and in the system for rolling up the cover by means of the buckles attached to the cover, "rope" may mean "string" or "wire."

The term "frame-chest" is also to be understood in the widest sense and in fact means that this is a trolley comprising a frame with support axles having wheels and/or rollers and a chest allowing to store the cover.

DETAILED DESCRIPTION OF THE INVENTION

The present invention discloses a multifunctional protection system for a sports ground, in particular football, rugby and hockey grounds, tennis courts and others, against the risks of bad weather such as torrential rain, long periods of frost or snow, . . . .

The system as in the invention has numerous advantages that are not restricted to the simple protection of sports grounds. Mention may be made of the following elements without restricting the possibilities:

- The protection cover 2 or canvas may serve as a large-scale support for advertising so it may be financed by a sponsor;
- The resistance of a protected ground that is rarely frozen or soaked is highly superior to that of an unprotected ground and therefore allows to organise numerous matches even off-season or when other grounds are not available;
- The number of training grounds for a single club may be reduced, which entails major benefits in terms of real estate;
- Lastly, improving the game conditions allows a general reduction in injuries and more skilful play at all times of year.

Figure 12:
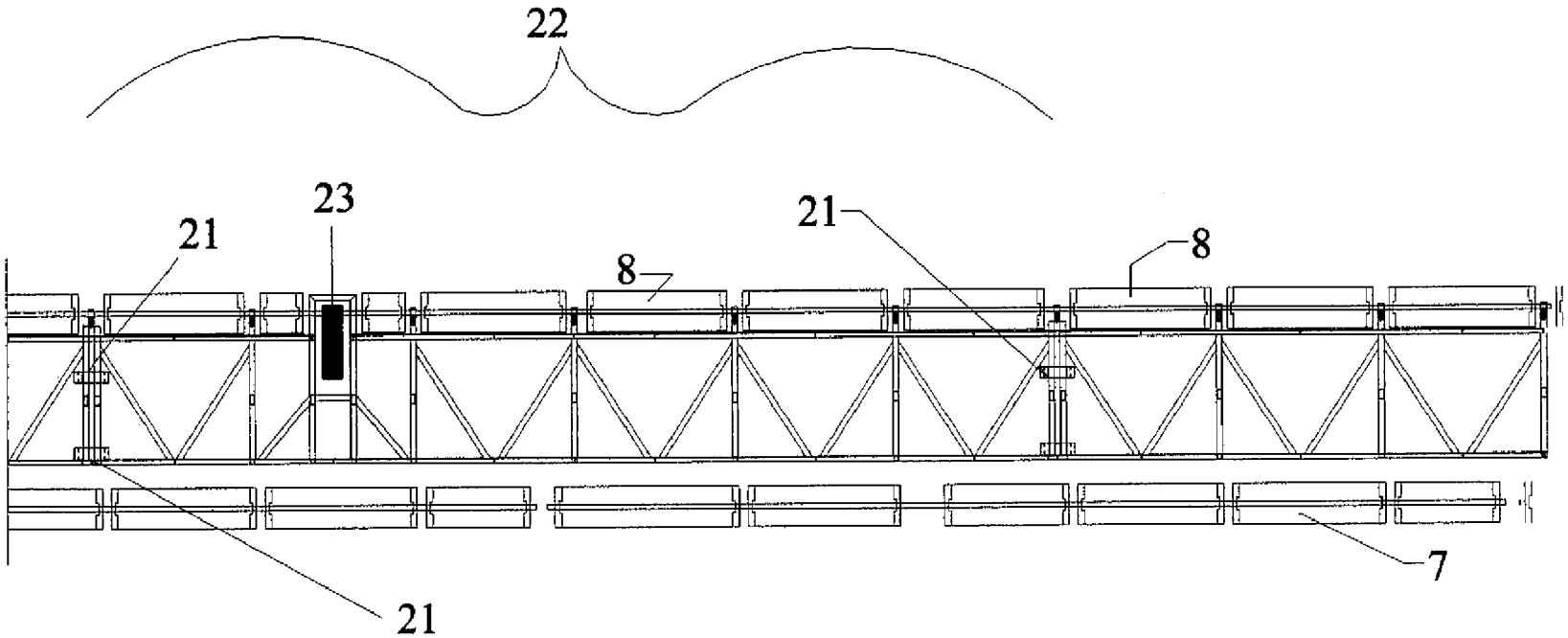
FIG. 12 shows a front view of a section through the frame-chest comprising a little more than one modular element, with a view of the linking parts connecting the modules of this frame-chest.

The protection system as in the present invention comprises two essential elements, on the one hand a network of cables 3 that must be spread out by operators on the sports ground and on the other a frame-chest 1 capable of folding and unfolding the cover 2. These cables, to which the frame-chest is attached, will serve to move the frame-chest 1 in the manner of a cable car, which spreads out or folds up the protection cover over the ground. This frame-chest normally comprises several modular elements 22 for covering the entire width of the ground. Each modular element of the frame-chest 1 preferably has a width of from 4 to 10 meters (13.1 feet to 32.8 feet) and preferably from 5 to 8 meters (16.4 feet to 26.2 feet) and, as a particular preference, 6 meters (19.7 feet). For a football ground, twelve 6-meters (19.7 feet) elements will thus be required to achieve a width of 72 meters (236.2 feet) in total. The modular elements 22 will have to move perfectly synchronously to ensure the correct spreading out of the protection cover 2. The elements are connected to each other by linking parts 21 that are shown in FIG. 12.

Figure 1:
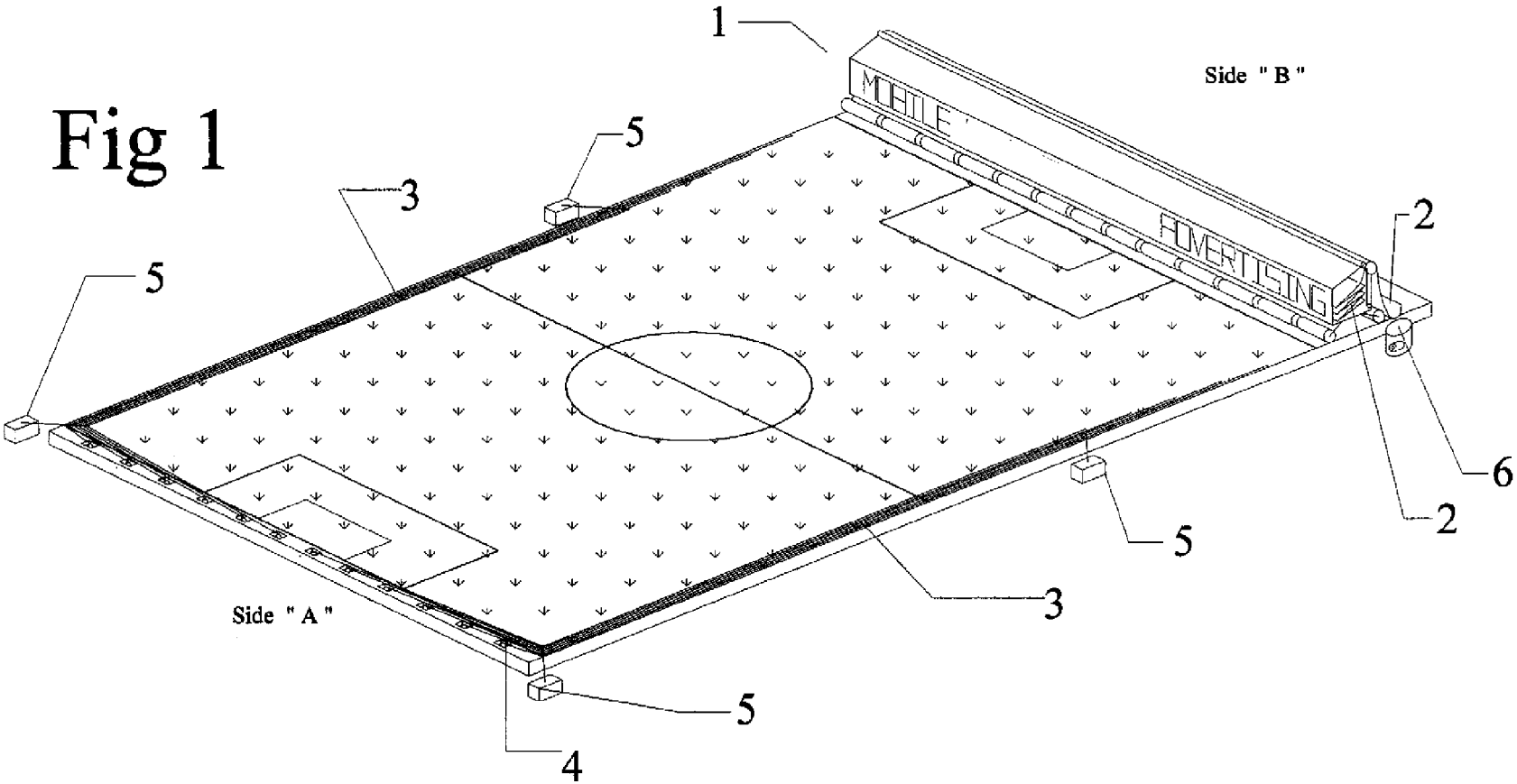
FIG. 1 shows a general view of a sports ground with the network of cables and the frame-chest elements located at the edge of the sports ground.
Figure 2:
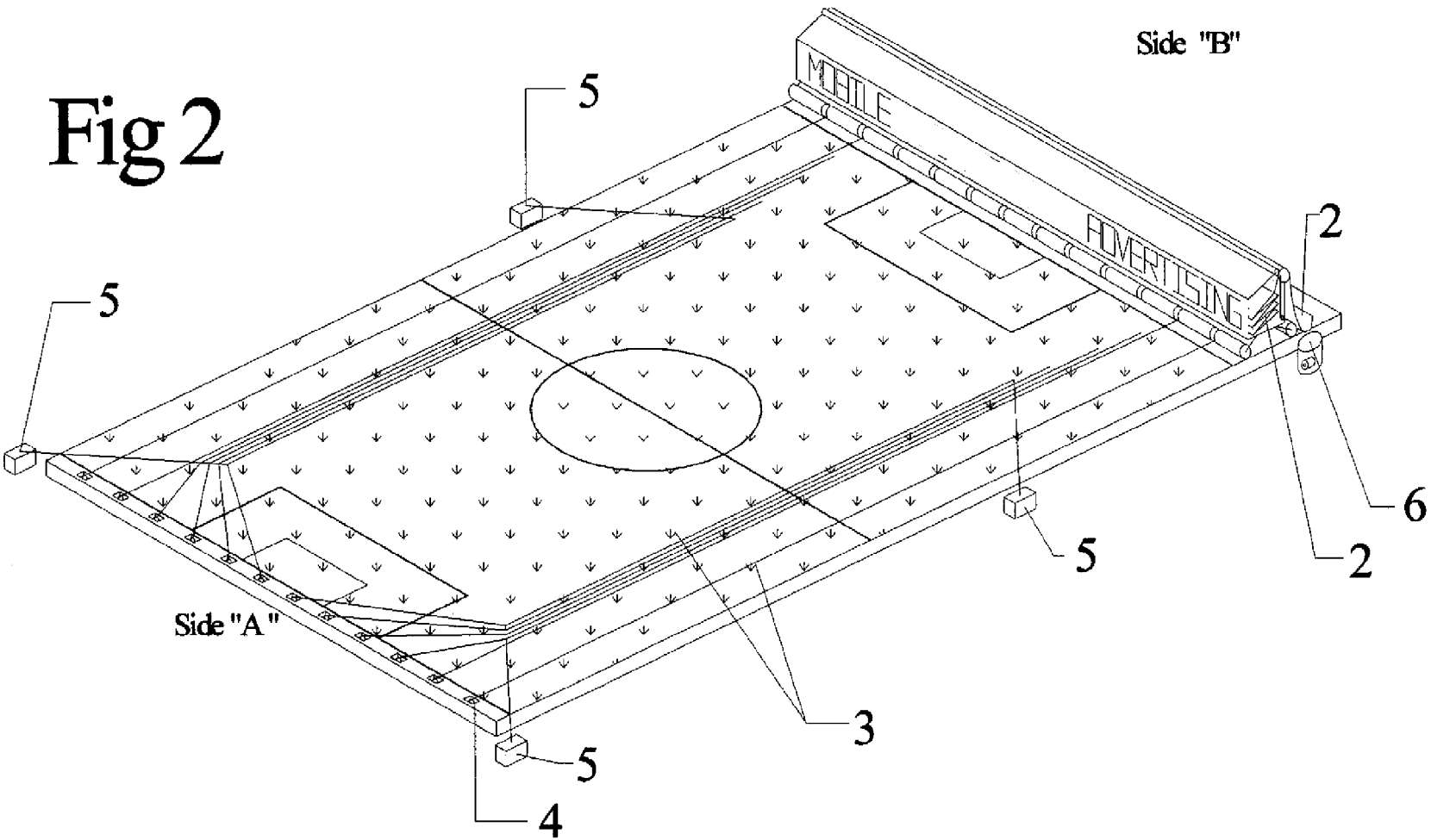
FIGS. 2 and 3 show the mechanism for spreading up the network of cables across the entire ground before activating the synchronous motion of the frame-chest elements. The network of cables is shown schematically and the double cables for each pulley are not shown.
Figure 3:
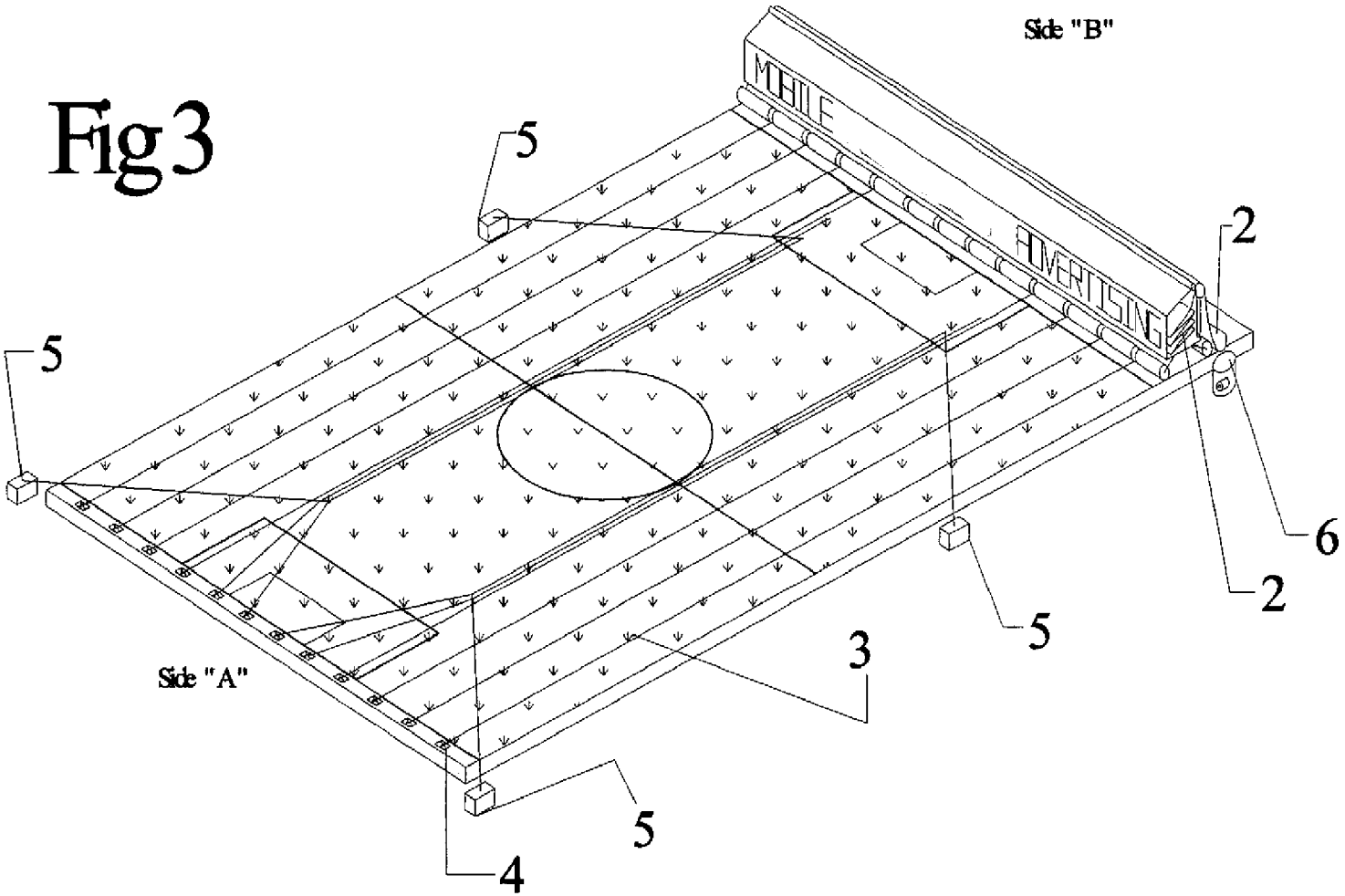
Figure 4:
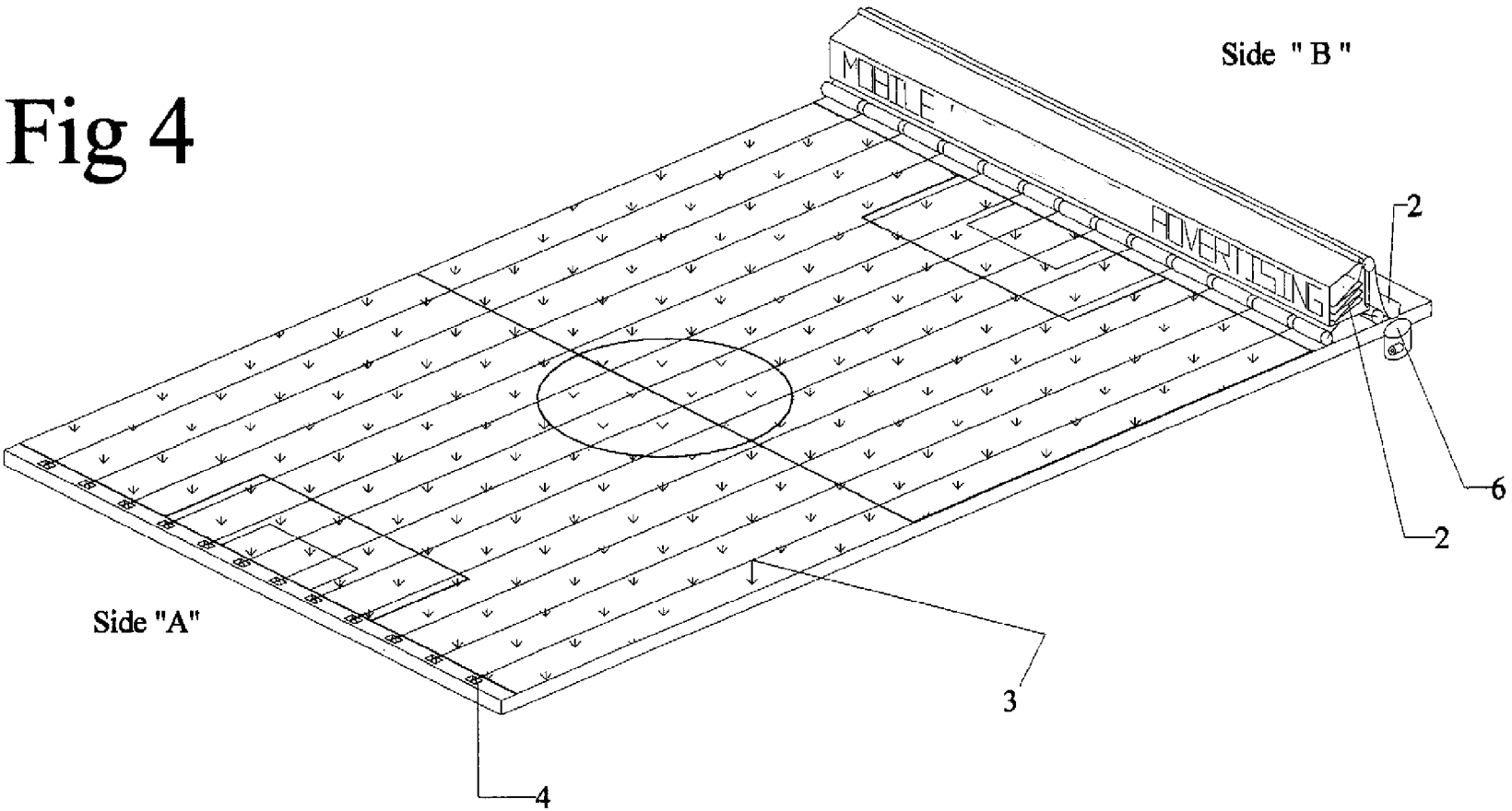
FIG. 4 shows the sports ground with the network of cables completely spread out.
Figure 5:
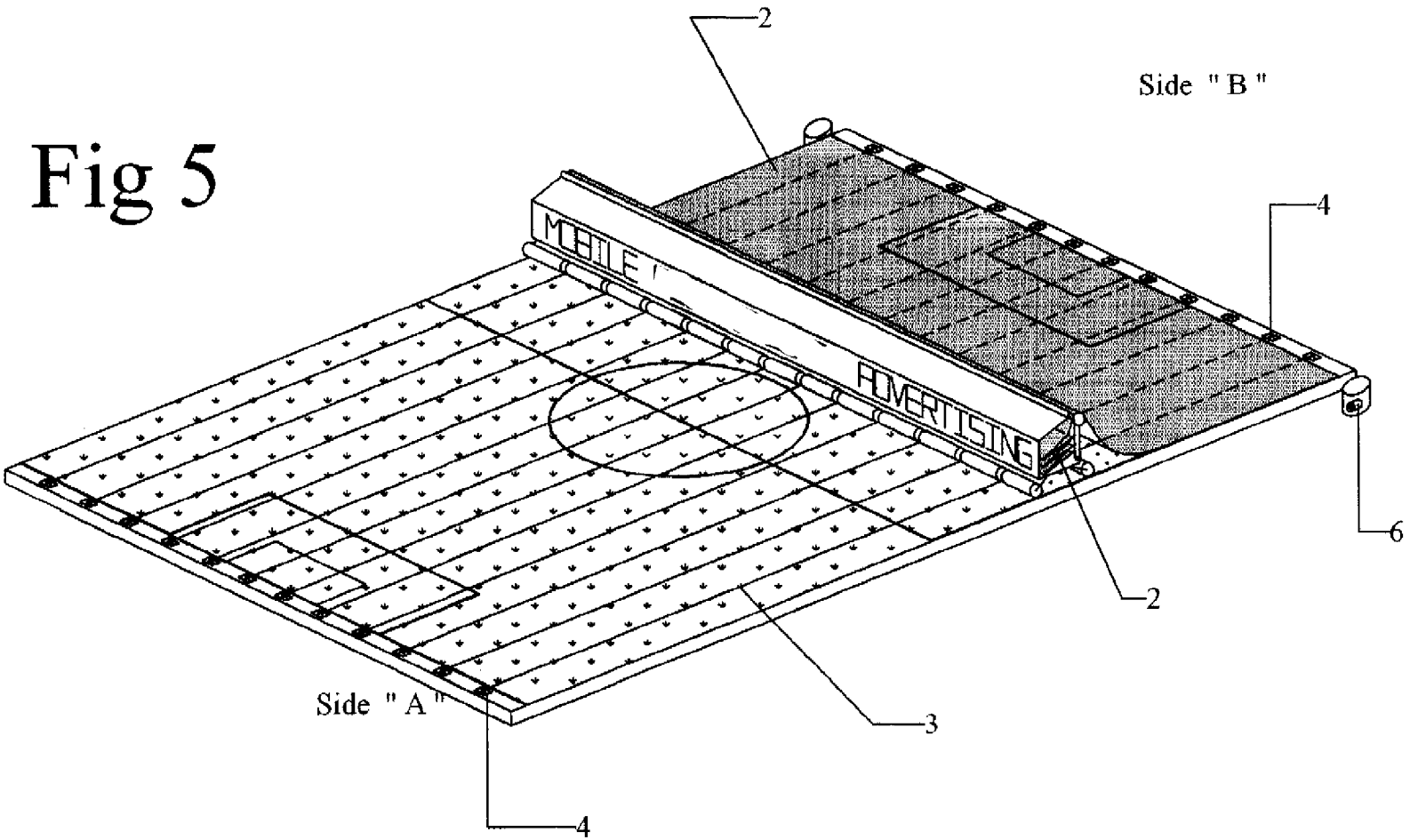
FIG. 5 shows the frame-chest comprising several elements in the middle of the sports ground, with a cover half spread out.
Figure 6:
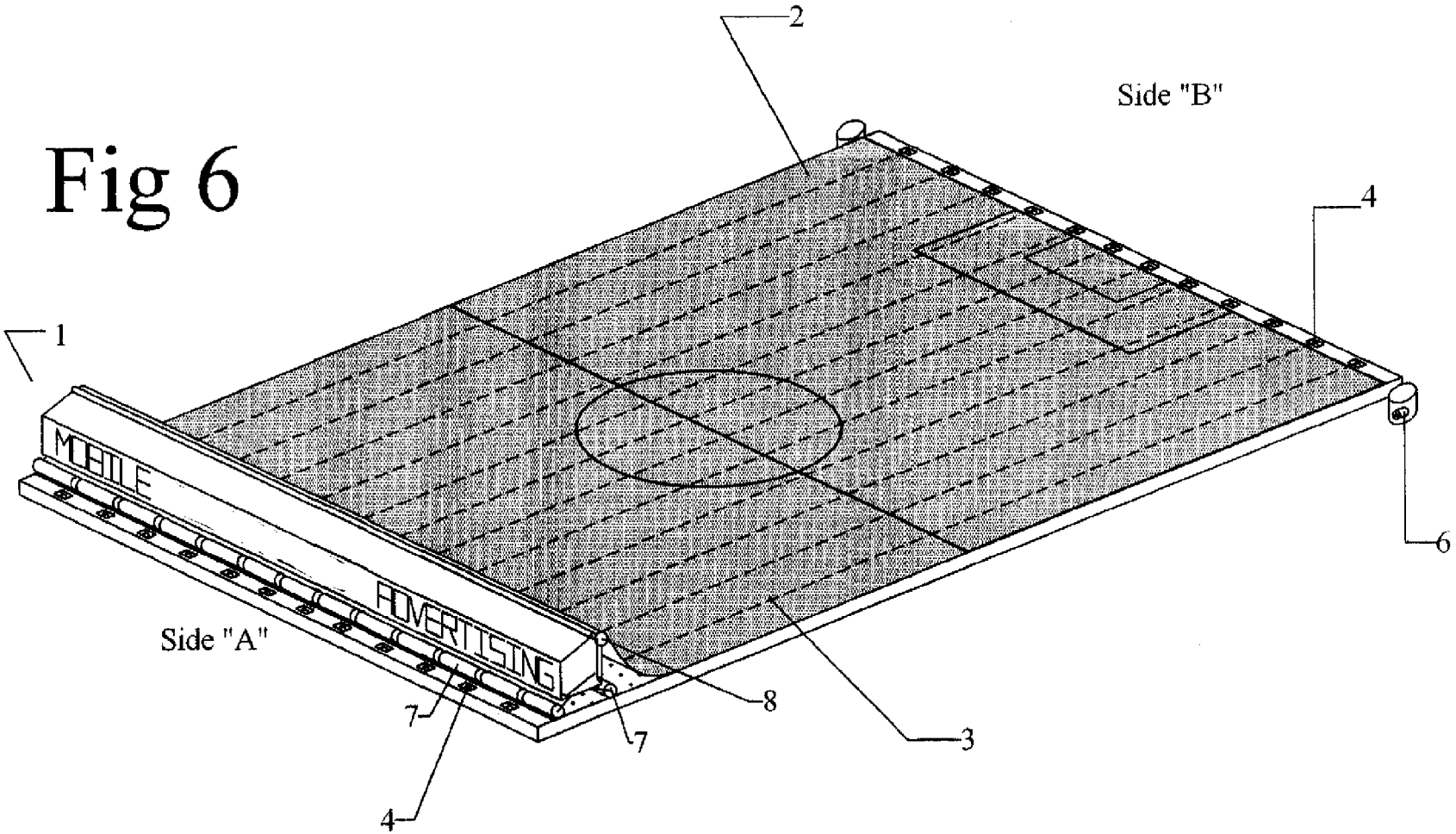
FIG. 6 shows the sports ground with a cover completely spread out by means of the system of the invention.
Figure 7:
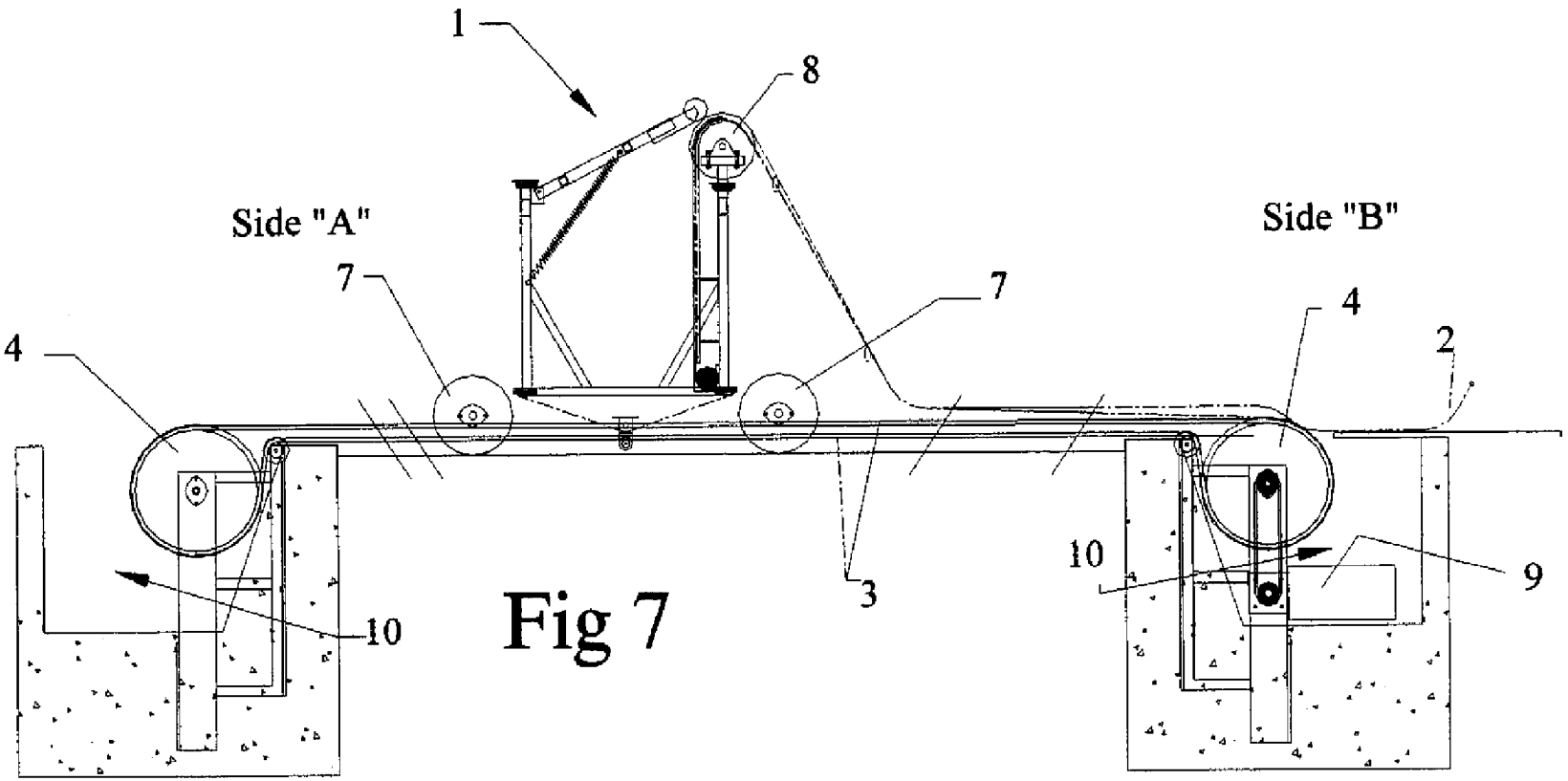
FIG. 7 shows a profile view of the system with the frame-chest comprising the mechanism for spreading out the cover, as well as a view of the motorized pulleys with their double cables used to move the frame-chest like a cable car, once the network of cables is set in place. The size of the ground is greatly reduced in the figure.

It turned out that equipping each individual element with a motor did not optimally ensure this synchronized motion for the reasons explained above (condition of the ground). To solve this problem, the present invention discloses a network of cables 3, to which the frame-chest 1 is attached, which will drive and guide its various elements like a cable car with motorized pulleys 4 incorporated to the edge of the ground. FIG. 7 shows how these pulleys 4 are positioned in a trench 10 at the edge of the ground. These pulleys may also be fixed to the ground without being buried if there is enough space at the edge of the ground. This embodiment is not shown in the figures. The position of the motor 9 is also indicated. It is also shown that the frame-chest 1 is attached to these cables underneath the frame, which is supported by the motion rollers 7 that allow it to move when the pulleys 4 turn and set the cables and hence the frame-chest in motion. The length of the cables 3 is about twice the length of the ground since two cables 3 are positioned in parallel at each attachment point. In the example of a football ground that is 72 meters (236.2 feet) wide, as shown in FIGS. 1 to 6, the cables 3 are stretched between twelve pulleys 4 positioned on either side of the ground. The network of cables 3 only has to be removed when people want to play on the ground. This network of cables 3 may therefore remain in place during the periods when the ground is covered and uncovered depending on the weather forecasts.

Winches 5 are provided along the sides for tidying away at the edge of the ground the relatively heavy cables 3 and they are used to draw in the network of cables 3 and gather it up. These winches 5 can be seen in FIGS. 1 to 3 and there are four of them. How these cables are gathered up is not shown in the figures but is provided for by means well known to those skilled in the art. It is also possible to roll up these cables 3 on coils that can be rolled across the ground after the cover 2 is folded up or before it is spread out (not shown).

On the lower side of the ground are located tanks 6 for the run-off water that would stagnate on the cover. These are intended to take the water from excess rain and may be equipped with a cellar-drainage pump or connected to the drain.

The cover 2 may be made of a single piece or made up of a patchwork of rectangular or square pieces (strips of technical textiles or canvas, of fixed width and continuous length). It is generally translucent and is placed directly on the ground, but it may also be raised if it is intended to blow air under the cover 2. On its lower side, the cover 2 comprises threading buckles 12 for the guiding ropes 11. These buckles 12 allow to create the folds in the canvas/cover 2 when it is being folded up in the frame-chest 1. For a football ground, for example, there will be "x" times 73 buckles under the canvas/cover, (=73 buckles times "x" strips of canvas required to make up the more than 7,000 meters squared (75,347.4 square feet) of a cover to go over a football ground).

The guiding ropes 11 have an important function since they allow the even spreading out of the cover 2 over the entire width of the ground. The guiding ropes 11 are attached to the edge of the ground and when the cover is being spread out over the ground by the motion of the frame-chest 1, they progressively come out of their case 16 where they are retained by a winding spring 18 so as to always have a certain tension, this is achieved like a dog's lead unwinding from its case. If one guiding rope is envisaged per meter of width of a football ground, 73 reels/cases will be required for the 72 meters (236.2 feet) of length of the frame-chest. When the cover is being folded up, the guiding ropes pass through the tubes 17 and are progressively rolled into the reels/cases 16 at the same time as the buckles 12 are threaded into these tubes 17.

In order to fold up the cover 2 when the frame-chest 1 moves, the motorized canvas-nipping rollers 8 start up. The nipping force is adjusted by a traction spring exerting a force on an arm, on which a pressure roller 13 is located. The rollers 8 and 13 are usually equipped with a clinging surface to aid nipping the cover 2. There is usually about one motor 23 per element of the frame-chest 1 for the nipping rollers 8, which are connected to each other by bearings. This can be seen in FIG. 12. The adjustment of the nipping force by means of the spring 14 is required to possibly lift any puddle of water on the cover 2.

Figure 9:
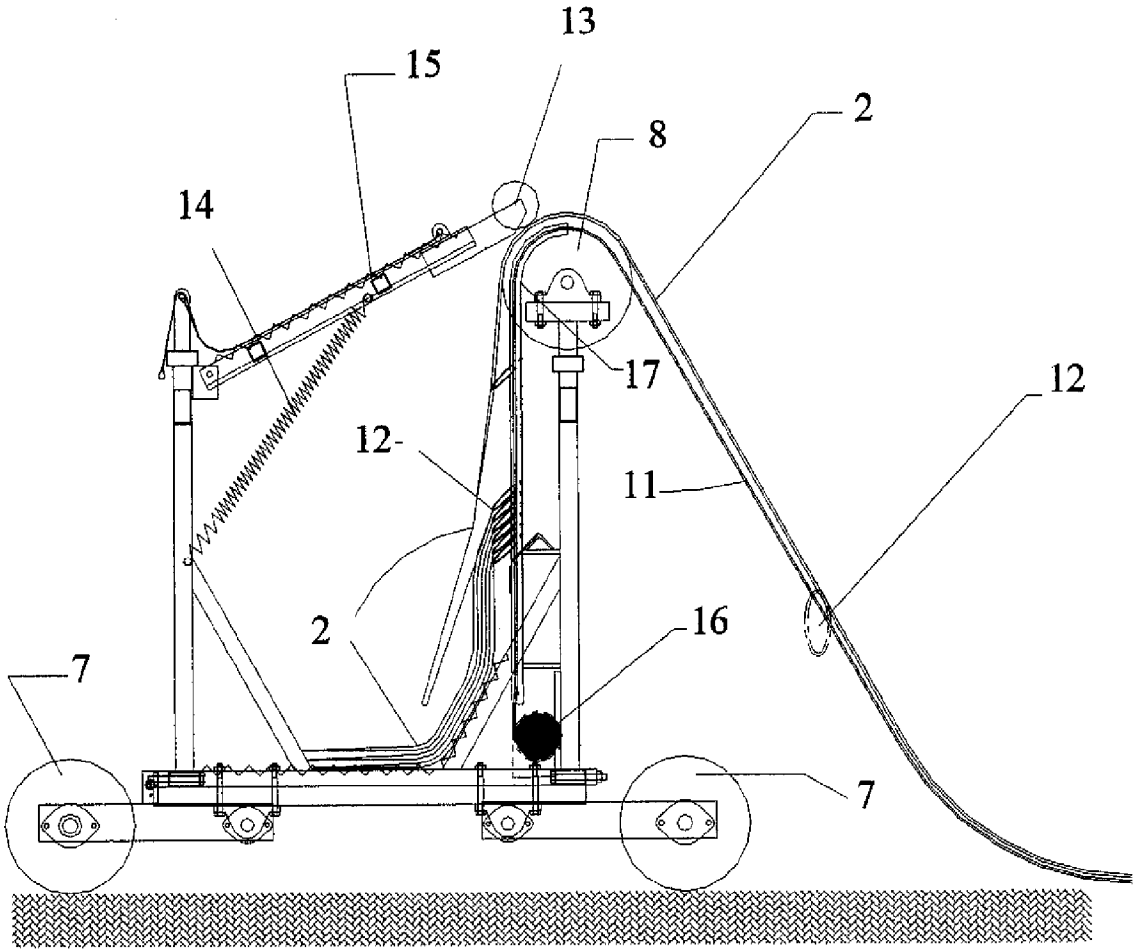
FIG. 9 shows a detailed view of all the elements making up the mechanism for spreading out the cover, which is located on the frame-chest.
Figure 10:
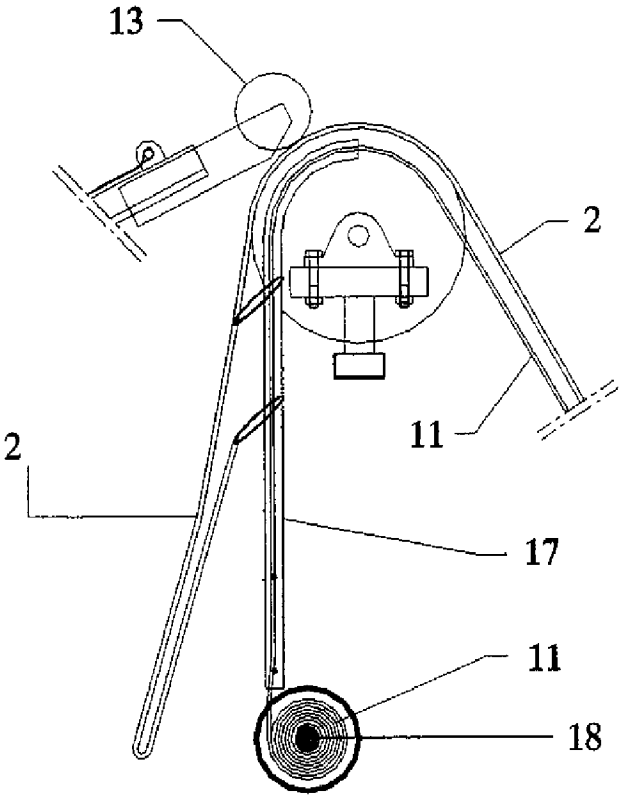
FIG. 10 shows a detailed view of the mechanism for folding up the cover, with in particular the reel for the guiding ropes and the threading tube for the guiding ropes and the buckles attached to the cover.

When the cover is being folded up, the guiding rope II and the buckles 12 are threaded into or over a threading tube 17. The ropes passing through the tube 17 and the buckles 12 moving to the outside around the tube 17 allow the cover 2 to be folded into a perfect accordion shape in the frame-chest 1. These various functions are shown in FIG. 9. Thus, as many threading tubes 17 per meter of width of the cover will be required as there are buckles 12 and guiding ropes 11.

Figure 8:
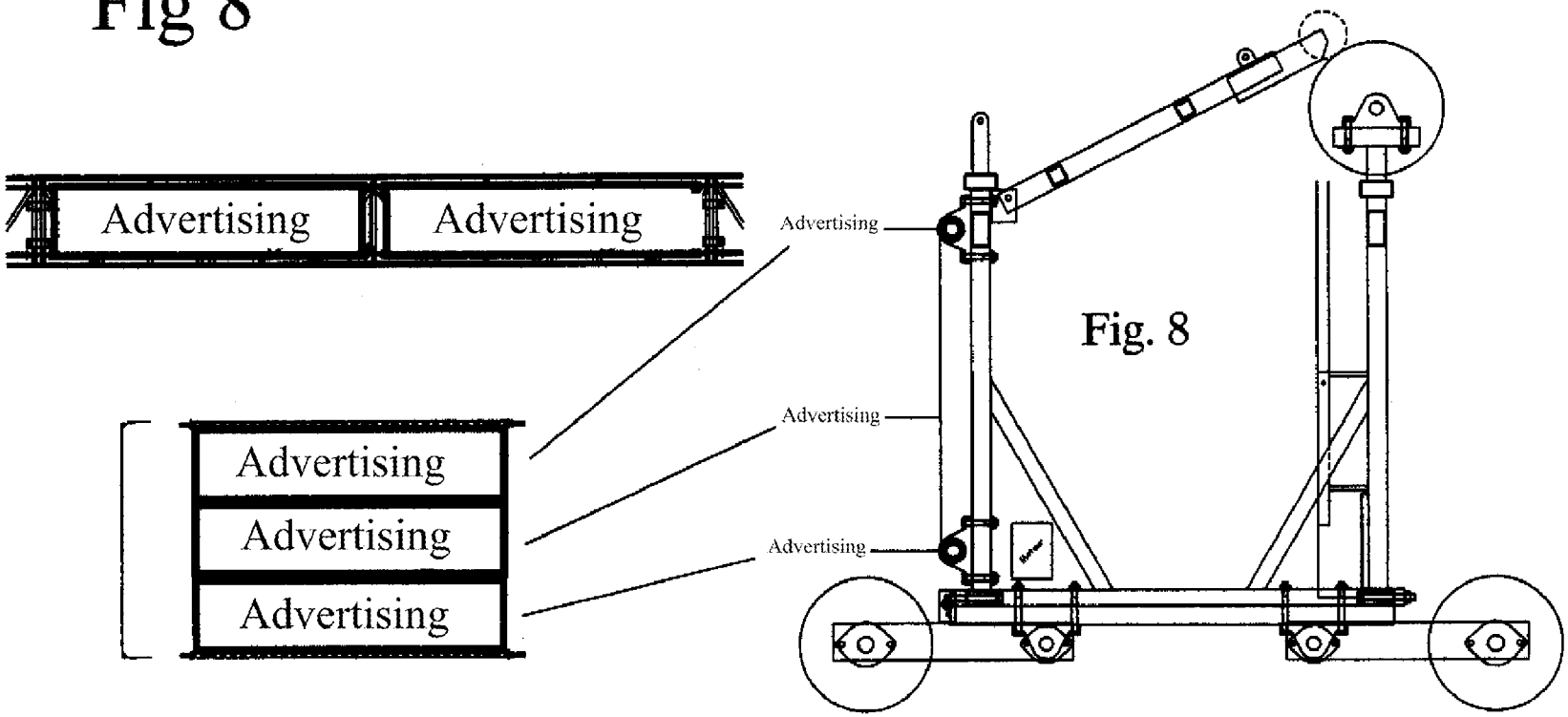
FIG. 8 shows a detailed view of the frame-chest with the option to attach advertising banners. The other functions are not shown in detail.
Figure 11:
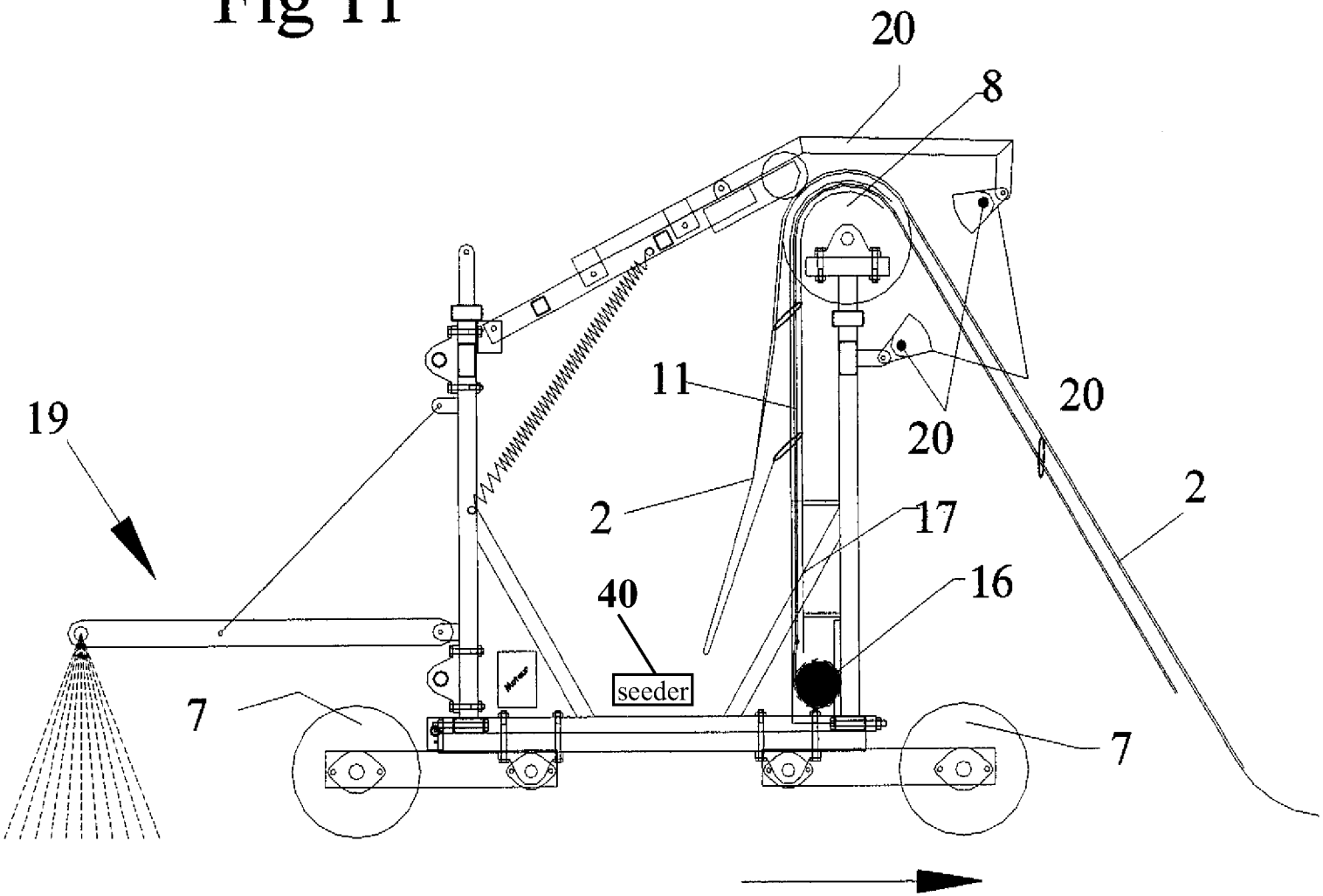
FIG. 11 shows an overall view of the heating and watering option on the frame-chest. The arrow shows the motion direction of the frame-chest.

The system of the present invention, and in particular the frame-chest 1, may be equipped with a whole series of options. Besides the advertising function mentioned earlier and shown in FIG. 8, the more traditional options are shown in FIG. 11, where the frame-chest 1 comprises a heating system 20 for the cover 2 and a watering system 19. The heating system shown in FIG. 11 comprises several radiant heat sources 20. These allow to limit heat losses and to heat up the cover 2 in order to dry it and make it less stiff in the event of frost before it is folded back into the frame-chest 1.

Other options are of course possible such as for example a mechanism 40 that allows to sow grass seeds on the ground (shown schematically at FIG. 11).

The frame-chest as in the invention is built as a mechanical device by assembling parts that can easily be replaced in the event of wear. All these elements may easily be removed and reinstalled.

KEY

1. Frame-chest
2. Cover
3. Network of cables
4. Motorized pulleys
5. Winch
6. Tanks for run-off water
7. Motion rollers for the frame-chest
8. Nipping roller for the cover
9. Pulley motor
10. Pulley trench
11. Guiding rope
12. Threading buckle
13. Pressure roller for nipping
14. Traction spring
15. Protection canvas for the frame-chest
16. Guiding-rope reel
17. Threading tube for the buckles and the guiding rope
18. Winding spring
19. Watering system
20. Heating system (radiant heat source)
21. Linking part for the elements of the frame-chest
22. Modular element of the frame-chest
23. Motors for the nipping rollers

The invention claimed is:

1. Protection system for a sports ground comprising a frame-chest (1) with a protection cover (2), said frame-chest (1) being able to move across the entire length of the ground whilst unfolding or folding said protection cover (2) by an unfolding and folding mechanism, wherein said frame-chest (1) is connected to a network of cables (3) spread out in advance over the sports ground, said cables (3) being operated by motorized pulleys (4) in order to ensure the motion of said frame-chest (1) over said sports ground.

2. Protection system as in claim 1, wherein said frame-chest (1) is divided into several modular elements (22) that move synchronously over the sports ground thanks to said network of cables (3), to which they are connected and which are operated by said motorized pulleys (4), when said cover (2) is being unfolded or folded.

3. Protection system as in claim 1, wherein said mechanism for unfolding or folding the cover (2) comprises nipping rollers (8), said nipping rollers (8) being themselves motorized and equipped with a regulation for the pressure force by means of arms equipped with springs (14), exerting a pressure force on the pressure rollers (13), pressing them onto said cover (2), the cover (2) being nipped between said nipping rollers (8) and the pressure rollers (13).

4. Protection system as in claim 1, wherein said mechanism for unfolding and folding the cover (2) comprises guiding ropes (11) attached to the edge of the ground that are threaded into threading buckles (12) located underneath said cover (2) and guide said cover (2) when it is being folded or unfolded.

5. Protection system as in claim 4, wherein, when said cover (2) is being folded, said guiding ropes (11) and said threading buckles (12) are threaded through and around a threading tube (17), respectively.

6. Protection system as in claim 4, wherein said mechanism comprises a reel (16) for said guiding ropes (11) equipped with a winding spring (18) which allows to progressively wind up or unwind the guiding rope (11), during the unfolding or folding of said cover (2), respectively.

7. Protection system as in claim 1, wherein said unfolding or folding mechanism for the cover comprises a synchronisation system that synchronises the motion speed of said frame-chest (1) by said motorized pulleys (4) with the folding or unfolding speed of the cover (2) by motorized nipping rollers (8).

8. Protection system as in claim 1, wherein said network of cables (3) as well as said motorized pulleys (4) are concealed at a side of the sports ground when it is uncovered.

9. Protection system as in claim 1, wherein said network of cables (3) is gathered up at the edge of the ground by several winches (5).

10. Protection system as in claim 1, wherein said frame-chest comprises a heating system (20) for said cover (2).

11. Protection system as in claim 1, wherein said frame-chest comprises a watering system (19).

12. Protection system as in claim 1, wherein said frame-chest has a seeder for sowing grass.

13. Protection system as in claim 1, wherein the frame-chest (1) comprises supports for advertising signs.

14. Protection system as in claim 1, wherein said cover is adapted serve as an advertising support.

15. Protection system as in claim 1, wherein the cover (2) is translucent.

* * * * *

UNITED STATES PATENT AND TRADEMARK OFFICE

CERTIFICATE OF CORRECTION

PATENT NO. : 7,901,307 B2
APPLICATION NO. : 12/438687
DATED : March 8, 2011
INVENTOR(S) : Bernard Hansez-Gonne It is certified that error appears in the above-identified patent and that said Letters Patent is hereby corrected as shown below:

On the Title page:
At the PCT Filed field (field code 22), replace August 28, 2008 with August 28, 2007.

Signed and Sealed this
Nineteenth Day of April, 2011

David J. Kappos

David J. Kappos
*Director of the United States Patent and Trademark Office*